United States Patent [19]

Bloching et al.

[11] 3,962,116

[45] June 8, 1976

[54] COMPOSITIONS OF OPTICAL BRIGHTNESS AND ALUMINOSILICATES AND METHODS OF THEIR PRODUCTION

[75] Inventors: Helmut Bloching, Hilden; Heinz Smolka, Langenfeld; Milan Johann Schwuger, Monheim, all of Germany

[73] Assignees: Henkel & Cie G.m.b.H., Dusseldorf-Holthausen; Deutsche Gold- und Silber-Scheideanstalt vormals Roessler, Frankfurt am Main, both of Germany

[22] Filed: Jan. 15, 1975

[21] Appl. No.: 541,208

[30] Foreign Application Priority Data

Jan. 17, 1974 Austria ..... 369/74

[52] U.S. Cl. ..... 252/301.21; 106/288 B; 106/309; 106/288 Q; 252/301.23; 252/301.27

[51] Int. Cl.[2] ..... C09K 11/30

[58] Field of Search ..... 106/288 B, 308 B, 308 Q, 106/288 Q; 252/301.2 W, 301.3 W

[56] References Cited

UNITED STATES PATENTS 3,669,896 6/1972 Preininger ..... 252/301.3 W

*Primary Examiner*—Winston A. Douglas
*Assistant Examiner*—J. V. Howard
*Attorney, Agent, or Firm*—Hammond & Littell

[57] ABSTRACT

Heat dried, finely-divided compositions of optical brighteners and fillers comprising as said fillers at least partly of a finely-divided water-insoluble silicate compound containing at least some combined water and having a calcium binding power of at least 50 mg CaO/gm of anhydrous active substance and the formula on the anhydrous basis $$(M_2/_nO)_x \cdot Me_2O_3 \cdot (SiO_2)_y$$

where M is a cation of the valence *n*, exchangeable with calcium, *x* is a member of from 0.7 to 1.5, Me is a member selected from the group consisting of aluminum and boron, and *y* is a number from 0.8 to 6, preferably from 1.3 to 4, in an amount of at least 5% by weight of the mixture, as well as a process for producing the same comprising the steps of mixing said silicate compound, while at least still moist from its production, with said optical brighteners and converting the entire mixture of components into a pourable product.

11 Claims, No Drawings

COMPOSITIONS OF OPTICAL BRIGHTNESS AND ALUMINOSILICATES AND METHODS OF THEIR PRODUCTION

THE PRIOR ART

The so-called "optical brighteners" are used in various industrial sectors, such as in the cellulose, paper and textile industry, as well as in the production of textile detergents in order to increase the whiteness of the fibers treated with them. To this end the optical brighteners are added to the aqueous treatment liquors in the above mentioned industries or they are incorporated in the textile detergents.

It is known to transform optical brighteners in the form of aqueous pulpy batches by hot drying, preferably by hot atomization, into easy to handle powders, particularly into beads. However, it has been found expedient to dry the brighteners in mixture with water-soluble inorganic fllers, such as NaCl or $Na_2SO_4$, because this reduces or eliminates the risk of thermal dissociations or fires or dust explosions on the hot rollers or in the atomizing towers.

OBJECTS OF THE INVENTION

An object of the present invention is the development of powdery, heat-dried compositions of optical brighteners and fillers where said fillers are capable of binding calcium.

Another object of the invention is the development of a heat-dried, finely-divided composition of optical brighteners and fillers consisting essentially of from 10 to 90% by weight of optical brighteners for textile fibers and from 10 to 90% by weight of fillers wherein from 50 to 100% by weight of said fillers is at least one compound inhibiting alkaline earth metal ion precipitation from aqueous solutions consisting of a finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence $n$, exchangeable with calcium, $x$ is a member of from 0.7 to 1.5, Me is a member selected from the group consisting of aluminum and boron, and $y$ is a number from 0.8 to 6; from 0 to 50% by weight of said fillers is an organic hydrotropic compound selected from the group consisting of anionic hydrotropic compounds and non-ionic hydrotropic compounds; and from 0 to 50% by weight of said fillers of a water-insoluble, finely-divided inert inorganic compound.

These and other objects of the invention will become more apparent as the description thereof proceeds.

DESCRIPTION OF THE INVENTION

The invention concerns heat-dried mixtures of optical brighteners and fillers. These are characterized in that the fillers consist at least partly of finely-dispersed water-insoluble silicate compounds containing at least some combined water and having a calcium binding power of at least 50 mg CaO/gm of anhydrous active substance of the general formula $$(M_{2/n}O)_x \cdot Me_2O_3 \cdot (SiO_2)y$$

where M denotes a cation of the valence n exchangeable with calcium, $x$ is a number from 0.7 to 1.5, Me is boron or aluminum, and $y$ is a number from 0.8 to 6, preferably 1.3 to 4, these compounds representing at least 5% by weight of the mixture.

The calcium binding power can attain values of 200 mg CaO/gm of anhydrous active substance (AS) and is preferably in the range of 100 to 200 mg CaO/gm AS.

More particularly the invention relates to a heat-dried, finely-divided composition of optical brighteners and fillers consisting essentially of from 10 to 90% by weight of optical brighteners for textile fibers and from 10 to 90% by weight of fillers wherein from 50 to 100% by weight of said fillers is at least one compound inhibiting alkaline earth metal ion precipitation from aqueous solutions consisting of a finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence $n$, exchangeable with calcium, $x$ is a member of from 0.7 to 1.5, Me is a member selected from the group consisting of aluminum and boron, and $y$ is a number from 0.8 to 6; from 0 to 50% by weight of said fillers is an organic hydrotropic compound selected from the group consisting of anionic hydrotropic compounds and non-ionic hydrotropic compounds; and from 0 to 50% by weight of said fillers of a water-insoluble, finely-divided inert inorganic compound.

The cation M employed is preferably sodium. However, the same can also be totally or partially replaced by other cations exchangeable with calcium, such as hydrogen, lithium, potassium, ammonium or magnesium, as well as by the cations of water-soluble organic bases, for example, by those of primary, secondary or tertiary alkylamines or alkylolamines with not more than 2 carbon atoms per alkyl radical, or not more than 3 carbon atoms per alkylol radical.

These compounds will hereafter be called "aluminosilicates" for simplicity's sake. Preferred are sodium aluminosilicates. All data given for their production and use also apply to the other compounds defined above.

The compositions according to the invention contain from 10 to 90%, more particularly from 40 to 90%, and preferably 50 to 90%, by weight of optical brighteners. The balance of the composition consists of the above-defined water-insoluble fillers or other water-soluble or finely-divided water-insoluble inert substances. The above-defined water-insoluble fillers, as well as their mixtures with other water-soluble and water-insoluble fillers are called here "fillers to be used according to the invention".

The advantage of the invention consists in that the above-defined compounds used according to the invention as fillers help by their calcium binding power to soften treatment liquors. Besides, their use is ecologically completely safe, in contrast to some other fillers.

The optical brighteners to be used according to the invention become attached on the fibers to be treated with them and effect thus the desired brighter appearance of the fibers. Depending on the chemical nature of the fibers to be brightened, such as cellulose, polyamide or polyester, different optical brighteners are used which have a special affinity to the respective fiber.

The optical brighteners are mostly, though not exclusively, derivatives of aminostilbene sulfonic acid or diaminostilbene di-sulfonic acid, of diaryl pyrazolines, of carbostyrils, of 1,2-di-(2-benzoxazolyl)-ethylene or 1,2-di-(benzimidazolyl)-ethylenes of benzoxazolyl-thiophenes, of coumarins and of distyryl-diphenyls.

Examples of brighteners from the class of the diaminostilbene acid derivatives are compounds, according to formula I:

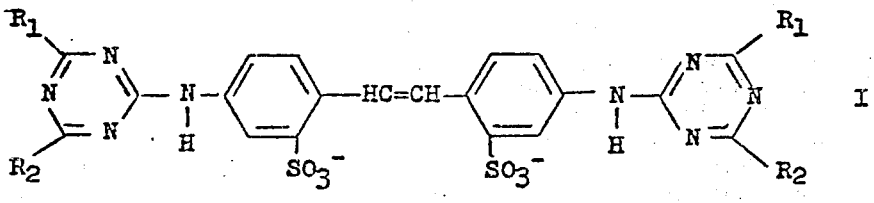

I

In the formula, $R_1$ and $R_2$ represent alkoxy, amino, or residues of aliphatic, aromatic or heterocyclic, primary or secondary amines as well as residues of aminosulfonic acids, where the aliphatic residues present in the above groups contain preferably 1 to 4 and particularly 2 to 4 carbon atoms, while the heterocyclic ring systems are mostly 5 to 6 membered rings. As aromatic amines the residues of the aniline, of the anthranilic acid or the anilinesulfonic acid are preferred. Brighteners, derived from the diaminostilbenedisulfonic acid, are mostly used as cotton brighteners. The following products, derived from formula I, are commercially available, where $R_1$ represents the residue $—NHC_6H_5$ and $R_2$ may represent the following residues: $—NH_2$, $—NHCH_3$, $—NHCH_2CH_2OH$, $—NHCH_2CH_2OCH_3$, $—NHCH_2CH_2CH_2OCH_3$, $—N(CH_3)CH_2CH_2OH$, $—N(CH_2CH_2OH)_2$, morpholino-, $—NHC_6H_5$, $—NHC_6H_4SO_3H$, $—OCH_3$. Some of these brighteners are, in regard to their fiber affinity, regarded as transitional types to the polyamide brighteners, such as the brightener with $R_2 = —NHC_6H_5$. The compound 4,4'-bis-(4-phenyl-1,2,3-triazole-2-yl)-2,2'-stilbenedisulfonic acid belongs also to the cotton brighteners of the diaminostilbenedisulfonic acid type.

Diarylpyrazolines of formulae II and III belong to the polyamide brighteners.

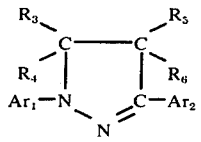

II

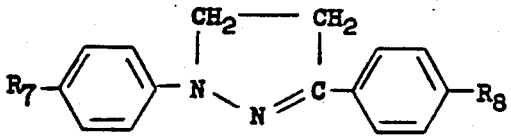

III

In formula II, $R_3$ and $R_5$ represent hydrogen, alkyl, and aryl, optionally substituted by carboxyl, carbonamide or carboxylic acid ester groups, $R_4$ and $R_6$ represent hydrogen or lower alkyl, $Ar_1$ and $Ar_2$ represent aryl radicals, such as phenyl, diphenyl or naphthyl, which may carry further substituents, such as hydroxy, alkoxy, hydroxyalkyl, amino, alkylamino, acylamino, carboxyl, alkoxycarbonyl, sulfo, sulfamoyl, alkanesulfonyl, alkenesulfonyl or halogen. Commercially available brighteners of this type are derived from the formula III, where the radical $R_7$ may represent the groups Cl, $—SO_2NH_2$, $—SO_2CH=CH_2$, and $—COOCH_2CH_2OCH_3$, while $R_8$ mostly represents a chlorine atom. Also the 9-cyanoanthracene belongs to the polyamide brighteners.

The polyamide brighteners further include aliphatically or aromatically substituted aminocoumarins, such as 4-methyl-7-dimethylamino-coumarin or 4-methyl-7-diethylamino-coumarin. Further usable as polyamide brighteners are the compounds 1-(2-benzimidazolyl)-2-(1-hydroxyethyl-2-benzimidazolyl)-ethylene and 1-ethyl-3-phenyl-7-diethylamino-carbostyril. Suitable as brighteners for polyester and polyamide fibers are the compounds 2,5-di-(2-benzoxazolyl)-thiophene, 2-(2-benzoxazolyl)-naphtho[2,3-b]-thiophene, and 1,2-di-(5-methyl-2-benzoxazolyl)-ethylene.

Furthermore, brighteners of the type of the distyryl-diphenyls of formula IV can be present

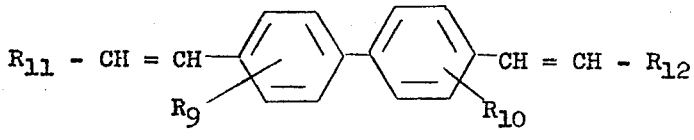

IV where each of $R_9$ and $R_{10}$ represents hydrogen or sulfonic acid. Both $R_9$ and $R_{10}$ as well as $R_{11}$ and $R_{12}$ may be the same or different. $R_{11}$ and $R_{12}$ represent phenyl or phenyl substituted with alkyl, hydroxyalkyl or alkoxy, all with 1 to 5 carbon atoms, chloro, cyano, carboxyl, sulfo, chlorosulfonyl and sulfamoyl, where one or both of the amide hydrogen atoms can be substituted by alkyl with 1 to 5 carbon atoms or hydroxyalkyl radicals with 2 to 4 carbon atoms, or where the amide nitrogen can be a part of a heterocyclic ring, for example, of morpholine. The preferred compounds are those where $R_{11}$ and $R_{12}$ are chlorophenyl, cyanophenyl, alkylphenyl, hydroxyalkylphenyl, alkoxyphenyl, carboxyphenyl and sulfophenyl, where all these substituted phenyl radicals can carry as a second substituent, a sulfonic acid group. Like the sulfonic acid group, the substituents —Cl, —CN and —COOH can be present twice on one phenyl ring.

As far as the optical brighteners to be used according to the invention represent sulfonic acids or carboxylic acids, they are preferably used in the form of their water-soluble salts of the alkali metals, of ammonium or of the alkylamines or alkylolamines with 1 to 6 carbon atoms in the molecule.

The above-defined known aluminosilicates to be used as fillers according to the invention can be produced synthetically in a simple manner, for example, by reacting water-soluble silicates with water-soluble aluminates in the presence of water. To this end aqueous solutions of the starting materials can be mixed with each other or one component which is present in solid form can be reacted with another component which is present as an aqueous solution. The desired aluminosilicates can also be obtained by mixing both solid components in the presence of water, preferably with comminution of the mixture. Aluminosilicates can also be produced from $Al(OH)_3$, $Al_2O_3$ or $SiO_2$ by reaction with alkali metal silicate or alkali metal aluminate solutions. Finally, such substances are also formed from the melt, but this method seems of less economical interest because of the required high melting temperature and the necessity of transforming the melt into finely-dispersed products.

The cation-exchanging aluminosilicates to be used according to the invention are only formed if special precipitation conditions are maintained, otherwise products are formed which have no, or an inadequate, calcium exchanging power. The calcium exchanging power of at least 50 mg CaO/gm of anhydrous active substance (AS) is critical to the present process. The production of usable aluminosilicates according to the invention is described in copending commonly-assigned U.S. patent application Ser. No. 458,306, filed Apr. 5, 1974, as well as in the experimental part.

The aluminosilicates in aqueous suspension produced by precipitation or by transformation in finely-dispersed form according to other methods can be transformed from the amorphous into the aged or into the crystalline state by heating the mother liquor suspension to temperatures of 50° to 200°C. There are some small differences between these two forms as far as the calcium binding power is concerned. However, apart from the drying conditions, this difference is proportional to the amount of aluminum contained in the aluminosilicates. Both types of aluminosilicates can be used for the purpose of the invention. The preferred calcium binding power, which is in the range of 100 to 200 mg CaO/gm AS, is found primarily in compounds of the composition:

$$0.7 \text{ to } 1.1\ Na_2O \,.\, Al_2O_3 \,.\, 1.3 \text{ to } 3.3\ SiO_2$$

This summation formula comprises two types of aluminosilicates which, if present in crystalline form, are distinguished by their crystal structures and their X-ray diffraction diagrams. These two types can also be present as their non-crystalline precursors and also differ by their summation formulas. These are a. $0.7 \text{ to } 1.1\ Na_2O \,.\, Al_2O_3 \,.\, 1.3 \text{ to } 2.4\ SiO_2$ b. $0.7 \text{ to } 1.1\ Na_2O \,.\, Al_2O_3 \,.\, >2.4 \text{ to } 3.3\ SiO_2$ The different crystal structures can be seen in the X-ray diffraction diagram. The d-values are given in the examples in the description of the production of the aluminosilicates I and II under the production conditions indicated therein.

The amorphous or crystalline aluminosilicates which are present in aqueous suspension can be separated by filtration from the remaining aqueous solution and be dried at temperatures of 50° to 800°C, for example. Depending on the drying conditions, the product contains more or less bound water. Anhydrous products are obtained at 800°C. If it is desired to expel the water completely, this can be done by heating for 1 hour to 800°C. This way the AS contents of the aluminosilicate are also determined.

Such high drying temperatures are not recommended for the aluminosilicates to be used according to the invention. Preferably the temperature should not exceed 400°C. It is a special advantage that even products which have dried at substantially lower temperatures, for example, of 80° to 200°C until the adhering water has been evaporated, can be used for the purposes of the invention. The aluminosilicates thus produced, which contain varying amounts of bound water, are obtained as fine powders after the dried filter cake has been comminuted, whose primary particle size does not exceed 0.1 mm, but is mostly substantially less, down to the fineness of dust, for example, down to 0.1 $\mu$. It must be kept in mind that the primary particles can agglomerate to larger structures. In some production methods primary particle sizes in the range of 50 to 1 $\mu$ are obtained.

Preferably, aluminosilicates, of which at least 80% by weight have a particle size of 0.01 to 10 $\mu$, preferably 0.1 to 8 $\mu$, are used in the process. Advantageously, they should have no primary or secondary particles above 40 $\mu$. To distinguish these fine aluminosilicates from the coarser products in this specification, they are designated, especially in the experimental part, as "microcrystalline" or "*m*".

The above-mentioned precipitation conditions can contribute to the formation of microcrystalline aluminosilicates, and the aluminate and silicate solutions to be mixed with each other, which can also be introduced simultaneously into the reaction vessel, can be subjected to great shearings forces. If the preferably used crystallized alumminosilicates are produced, the formation of large intergrown crystals is prevented by slowly stirring the crystallizing mass.

Nevertheless an undesired agglomeration of crystalline particles may occur during the drying, so that it is advisable to remove these secondary particles in a suitable manner, for example, by air sifting. Aluminosilicates which are obtained in a coarser state and which have been ground to the desired particle size, can also be used. Suitable equipment is, for example, mills and/or air-sifter or combinations thereof. The latter are described, for example, in Ullman, "Enzyklopaiedie der technischen Chemie", Vol. 1, 1951, pp. 632–634.

From the sodium aluminosilicates, the aluminosilicates of other cations, for example, of potassium, magnesium or water-soluble organic bases can be produced in a simple manner by base exchange. The use of these compounds instead of the sodium aluminosilicates may be advisable if it is desired to achieve a special effect by giving off the above-mentioned cations, for example, to affect the state of solution of the brighteners.

Other water-insoluble, finely-divided, inert inorganic fillers that can be used according to the invention are, for example, microcrystalline silica or finely-divided magnesium silicates or finely-divided aluminosilicates, which includes salts of magnesium or aluminum with silica.

The mixtures according to the invention can be produced as follows:

1. The still moist optical brighteners, which occur as a liquid aqueous suspension or outwardly dry (for example, a filter cake) are mixed with the fillers to be used according to the invention, the latter being present either as dry powders, as products which appear dry but are still moist (filter cakes) or as aqueous suspensions. These mixtures are then dried by any desired method, for example, on rollers, or preferably by hot atomization.

2. The aluminosilicates are formed in situ in the presence of a suspension of solid, finely-divided optical brighteners, and the resulting mixtures are transformed into a dry powder. In the mixtures thus obtained, the brighteners are enveloped by the aluminosilicates formed.

During the processing of the brighteners in the form of moist filter cakes it was found that their transformation into pumpable suspensions is enhanced by the addition of anionic or non-ionic hydrotropic compounds. The anionic hydrotropic compounds include, for example, the readily soluble salts of aromatic sulfonic acids, such as the sodium salts of benzenesulfonic acid, toluene-sulfonic acid, xylenesulfonic acid, cumenesulfonic acid, phenolsulfonic acid, diphenylsulfonic acid or diphenylether-sulfonic acid, as well as the sodium salts of formaldehyde condensation products of phenol sulfonic acid or diphenyl-ether-sulfonic acids. The non-ionic hydrotropic compounds are, for example, the relatively water-insoluble non-surface-active polyoxyethylene glycols.

It was found that the optical brighteners of the type of diaminostilbene-disulfonic acids in aqueous suspensions are transformed gradually from the desired white modification into the crystalline water-containing undesired yellow modification. For this reason the working conditions should be so elected that the dwelling time of these brighteners in the aqueous suspension does not exceed 5 minutes. This undesirable transformation is also delayed by the presence of anionic hydrotropic substances.

In the method under (2), the optical brightener can be added at random either to the sodium silicate solution or the sodium aluminate solution before the aluminosilicates are formed. It can also be added during the mixing of the two solutions, particularly if one of the two solutions is not charged and both are introduced simultaneously into the reaction vessel.

But if the aluminosilicates are formed in the presence of the brighteners, the envelopment of the brighteners by the aluminosilicates obviously prevents the above-mentioned transformation into the yellow modification. This is a particular advantage of the method, since such aqueous suspensions can be used for the manufacture of detergents without a preceding drying process.

The suspensions obtained by the precipitation of the aluminosilicates contain mostly excess alkali which can be neutralized completely or partly before the suspensions are dried. Suitable for this purpose are acid anhydrides, acids or acid salts, such as $CO_2$, $NaHCO_3$, $NaHSO_4$, $NaH_2PO_4$, as well as other substancs which bind excess alkali under the present conditions.

The products according to the invention can be used directly for the above-mentioned purposes, that is, they can be introduced directly into the treatment liquors, or be used for the manufacture of detergents.

The following specific embodiments are illustrative of the invention without being limitative in any respect.

EXAMPLES

First, the production of the finished aluminum silicates is described, for which no invention is claimed.

PROCESS CONDITIONS

The aluminate solution, diluted with deionized water was mixed in a vessel of 15 liter capacity, under vigorous stirring with the silicate solution. Both solutions were at room temperature. An X-ray amorphous sodium aluminosilicate was formed in the exothermic reaction as a primary precipitation product. After stirring for 10 minutes, the suspension of the precipitation product was either separated as an amorphous product or transferred to a crystallization vessel where it remained for some time at the elevated temperature given to crystallize. After draining off the liquor from the crystals and washing with deionized water until the outflowing wash water had a pH-value of about 10, the filter residue was dried. When there is any deviation from this general production procedure, this mentioned explicitly in the specific part. Thus, for example, in some cases for the practical tests, the homogenized uncrystallized suspension of the precipitation product or the crystal sludge was used. The water content was determined by heating the product for 1 hour to 800°C.

In the production of microcrystalline aluminosilicates, indicated by the suffix *m*, the aluminate solution diluted with deionized water was mixed with the silicate solution and mixed in a high-speed intensive stirrer (10,000 rpm, "Ultraturrax", made by Janke & Kunkel IKA-Werk, Stauffen/Breisgau/Federal Republic of Germany). After vigorous stirring for 10 minutes, the suspension of the amorphous precipitation product was transferred to a crystallization vessel where the formation of large crystals was prevented by stirring the suspension. After draining off the liquor and washing with deionized water until the outflowing water had a pH value of about 10, the filter residue was dried, then ground in a ball mill and separated in a centrifugal sifter ("Microplex" air sifter, made by Alpine, Augsburg, Federal Republic of Germany) into two fractions, of which the finer fraction contained no portions above 10 $\mu$. The particle size distribution was determined by means of a sedimentation scale.

The degree of crystallization of an aluminosilicate can be determined from the intensity of the interference lines of an X-ray diffraction diagram of the respective product, compared to the corresponding diagrams of X-ray amorphous or fully crystallized products.

All data in % are in percent by weight.

The calcium binding power of the aluminosilicates or borosilicates was determined in the following manner. 1 liter of an aqueous solution, containing 0.594 gm of $CaCl_2$ (= 300 mg CaO/1 = 30°dH) and adjusted to a pH of 10 with diluted NaOH, was mixed with 1 gm of the aluminosilicate or borosilicate (on the anhydrous basis, AS). Then the suspension was stirred vigorously for 15 minutes at a temperature of 22°C (±2°C). After filtering off the aluminosilicate, the residual hardness x of the filtrate was determined. From it, the calcium binding power was calculated in mg CaO/gm. As according to the formula: $(30 - x) \cdot 10$ If calcium binding power is determined at higher temperature, for example, at 60°C, better values are obtained than at 22°C. This fact distinguishes the aluminosilicates from most of the soluble sequestering agents that have been suggested so far for use in detergents and represents a particular technical progress in their use.

REPRESENTATIVE ALUMINOSILICATES

Production conditions for aluminosilicate I

Precipitation:
- 2.985 kg of an aluminate solution of the composition: 17.7% $Na_2O$, 15.8% $Al_2O_3$, 66.6% $H_2O$
- 0.15 kg of sodium hydroxide
- 9.420 kg of water
- 2.445 kg of a 25.8% sodium silicate solution of the composition 1 $Na_2O$. 6.0 $SiO_2$, prepared freshly from commercial waterglass and easily alkali-soluble silica Crystallization:
- 24 hours at 80°C Drying:
- 24 hours at 100°C Composition:
- 0.9 $Na_2O$ . 1 $Al_2O_3$ . 2.05 $SiO_2$ . 4.3 $H_2O$ (=21.6& $H_2O$)

Degree of crystallization:
- Fully crystalline

Calcium binding power:
- 150 mg CaO/gm AS.

If the product obtained was dried for 1 hour at 400°C, an aluminum silicate Ia was obtained of the composition:

0.9 $Na_2O$ . 1 $Al_2O_3$3 2.04 $SiO_2$. 2.0 $H_2O$ (=11.4% $H_2O$)

which is likewise suitable for the purposes of the invention.

Product conditions for aluminosilicate II

Precipitation:
- 2.115 kg of an aluminate solution of the composition: 17.7% $Na_2O$ 15.8% $Al_2O_3$, 66.5% $H_2O$
- 0.585 kg of sodium hydroxide
- 9.615 kg of water
- 2.685 kg of a 25.8% sodium silicate solution of the composition: 1 $Na_2O$. 6 $SiO_2$ (prepared as under I)

Crystallization:
- 24 hours at 80°C

Drying:
- 24 hours at 100°C and 20 torr.

Composition:
- 0.8 $Na_2O$. 1 $Al_2O_3$. 2.655 $SiO_2$. 5.2 $H_2O$

Degree of crystallization
- Fully crystalline

Calcium binding power:
- 120 mg CaO/gm AS.

This product too can be dehydrated by drying (for 1 hour at 400°C) to the composition:

0.8 $Na_2O$. 1 $Al_2O_3$. 2.65 $SiO_2$. 0.2 $H_2O$

This dehydration product IIa is likewise suitable for the purposes of the invention.

The aluminosilicates I and II show in the x-ray diffraction diagram the following interference lines.

| d-values, recorded with Cu—$K_\alpha$—rradiation in A | |
|---|---|
| I | II |
| — | 14.4 |
| 12.4 | — |
| — | 8.8 |
| 8.6 | — |
| 7.0 | — |
| — | 4.4(+) |
| 4.1(+) | — |
| — | 3.8 (+) |
| 3.68 (+) | — |
| 3.38 (+) | — |
| 3.26 (+) | — |
| 2.96 (+) | — |
| — | 2.88 (+) |
| — | 2.79 (+) |
| 2.73 (+) | — |
| — | 2.66 (+) |
| 2.60 (+) | — |

It is quite possible that not all these interference lines will appear in the X-ray diffraction diagram, particularly if the aluminosilicates are not fully crystallized. For this reason, the d-values which are the most important for the characterization of these types are identified by a "(±)".

Production conditions for aluminosilicate III

Precipitation:
- 2.985 kg of an aluminate solution of the composition: 17.7% $Na_2O$, 15.8% $Al_2O_3$, 66.5% $H_2O$
- 0.150 kg of sodium hydroxide
- 9.420 kg of water
- 2.445 kg of a 25.8% sodium silicate solution of the composition: 1 $Na_2O$. 6 $SiO_2$ (prepared as in I)

Crystallization:
- none, amphorous precipitate

Drying:
- 24 hours at 25°C and 20 torr.

Composition:
- 0.9 $Na_2O$ . 1 $Al_2O_3$ . 2.04 $SiO_2$ . 47 $H_2O$

Degree of crystallization:
- X-ray amorphous

Calcium binding power:
- 160 mg CaO/gm AS.

Production conditions for aluminosilicate XIII

Precipitation:
- 2.985 kg of an aluminate solution of the composition: 17.7% $Na_2O$, 15.8% $Al_2O_3$, 66.5% $H_2O$
- 0.150 kg of sodium hydroxide
- 9.520 kg of water
- 2.445 kg of a 25.8% sodium silicate solution of the composition: 1 $Na_2O$ . 6 $SiO_2$ (prepared as in I)

Crystallization:
- 24 hours at 80°C

For the production of a potassium aluminosilicate, the liquor was drained off, the residue washed with water and suspended in an aqueous KCl solution. After heating for 30 minutes to 80°–90°C, the product was filtered off and washed.

Drying:
24 hours at 100°C
Composition:
0.28 $Na_2O$ . 0.62 $K_2O$ . 1 $Al_2O_3$ . 2.04 $SiO_2$. 4.3 $H_2O$
Degree of crystallization:
Fully crystalline
Calcium binding power:
170 mg CaO/gm AS Production conditions for borosilicate XVI Precipitation:
3.20 kg of a borate solution of the composition: 19.7% $Na_2O$, 19.7% $B_2O_3$, 60.6% $H_2O$
9.55 kg of water
2.55 kg of a 34.5% sodium silicate solution of the composition: 1 $Na_2O$ . 3.46 $SiO_2$
Crystallization:
24 hours at 80°C
Drying:
24 hours at 100°C and 20 torr.
Composition:
1.5 $Na_2O$ . 1 $B_2O_3$ . 2 $SiO_2$ . 1.5 $H_2O$
Degree of crystallization:
Primarily crystalline
Calcium binding power:
120 mg CaO/gm AS The primary particle sizes of the alumino- or borosilicates, I, II, III, XIII and XVI described range from 10 to 45 m$\mu$.

Production conditions for aluminosilicate Im

Precipitation:
As in aluminosilicate I
Crystallization:
6 hours at 90°C
Drying:
24 hours at 100°C
Composition:
0.9 $Na_2O$ . 1 $Al_2O_3$ . 2.05 $SiO_2$ . 4.3 $H_2O$ (= 21.6% $H_2O$)
Degree of crystallization:
Fully crystalline
Calcium binding power:
170 mg CaO/gm AS Production conditions for aluminosilicate IIm Precipitation:
As for aluminosilicate II
Crystallization:
12 hours at 90°C
Drying:
24 hours at 100°C and 20 torr.
Composition:
0.8 $Na_2O$ . 1 $Al_2O_3$ . 2.655 $SiO_2$ . 5.2 $H_2O$
Degree of crystallization:
Fully crystalline
Calcium binding power:
145 mg CaO/gm AS Production conditions for aluminosilicate XIIIm Precipitation:
As for aluminosilicate XIII
Crystallization:
6 hours at 90°C
For the production of the potassium-aluminum silicate the liquor was drained off, the residue was washed with water and suspended in an aqueous KCl solution. The product was filtered off after heating for 30 minutes to 80–90°C and washed.

Drying:
24 hours at 100°C
Compositon:
0.28 $Na_2O$ . 0.62 $K_2O$ . 1 $Al_2O_3$ . 2.04 $SiO_2$ . 4.3 $H_2O$
Degree of crystallizaton
Fully crystalline
Calcium binding power:
180 CaO/gm AS The particle size of the above-described microcrystalline products Im, IIm and XIIIm, determined by sedimentation anaysis, was in the following range.
$> 40\ \mu = 0\%$ maximum range of the particle
$< 10\ \mu = 100\%$ size distribution curve at 3 to 6 $\mu$
$< 8\ \mu = 50$ to 95%

EXAMPLE 1

90 kg of 4,4′-bis-(2-anilino-4-morpholino-1,3,5-triazin-6-yl-amino)-stilbene-2,2′-disulfonic acid, sodium salt, in the form of a filter cake obtained during the production and containing about 65% by weight of water, were transformed by vigorous stirring into a fluid suspension, after the addition of 3 kg of a diphenyl-disulfonic acid/formaldehyde condensation product (Na salt) and 7 kg of the sodium aluminosilicate described below.

The crystalline sodium aluminosilicate had the following composition:

$$Na_2O \cdot Al_2O_3 \cdot 2\ SiO_2 \cdot 4\ H_2O$$

The water content was determined by heating the product, which had been dried at 110° to 800°C for 1 hour. The calcium binding power related to the anhydrous active substance (AS) is 175 mg CaO/gm AS.

The particle size distribution of this sodium aluminosilicate determined by sedimentation analysis was in the following range:
over 40 $\mu = 0\%$ by weight maximum range of the
under 10 $\mu = 100\%$ by weight particle size distribution
under 8 $\mu = 99\%$ by weight at 1 to 3 $\mu$.

After the pH value of the suspension was adjusted to 10, the latter was sprayed by means of a single substance nozzle in known manner into air of about 210°C and thus transformed into a powder consisting of beads.

EXAMPLE 2

81 kg of 1-(p-sulfamoylphenyl)-3-(p-chlorophenyl)-2-pyrazoline were processed in the form of a filter cake with about 55% by weight of water content in admixture with 4 kg of a polyoxyethylene glycol (molecular weight = 600) and 15 kg of the sodium aluminosilicate described in Example 1 in a kneading screw to a fluid suspension, which was then transformed as described in Example 1, by hot atomization into a beaded powder.

EXAMPLE 3

The method according to Example 2 was repeated with the same success, using 81 kg of 1-ethyl-3-phenyl-7-dimethylamino-carbostyril in the form of a filter cake with 55% by weight of water content.

EXAMPLE 4

The method according to Example 2 was repeated with the same success, using filter cakes of the following optical brighteners:

a. 3-phenyl-7-(4-phenyl-5-methyl-1,2,3-triazolyl)-coumarine
b. 2-(2-benzoxazolyl)-naphtho-[2,3-b]-thiophene
c. 1-(2-benzoxazolyl)-2-(4-cyanophenyl)-ethylene
d. 2,5-di-(2-benzoxazolyl)-thiophene.

In the methods according to Examples 1 to 4, the process was conducted so that the dwell time of the suspensions formed, that is, the time from their formation to the completed atomization, did not exceed 5 minutes.

EXAMPLE 5

This example describes a variant of the method according to the invention where the optical brightener was suspended in the aluminate solution charged, and the sodium aluminosilicate was precipitated in the presence of the brightener by adding the sodium silicate solution. The mixture was stirred vigorously at 25°C for 10 minutes.

The following substances were mixed with each other:

8.450 kg of an aluminate solution of the composition:

11.3% $Na_2O$, 18.7% $Al_2O_3$, 70.0% $H_2O$ 11.249 kg of the optical brightener according to Example 1 (active substance)
13.926 kg of di-ionized water
6.550 kg of a 34.9% sodium silicate solution of the composition:

8.0% $Na_2O$, 26.9% $SiO_2$, 65.1% $H_2O$

The anhydrous, ion-exchanging sodium aluminosilicate formed had the following composition:

$0.95\ Na_2O \cdot 1.0\ Al_2O_3 \cdot 1.89\ SiO_2$ and a calcium binding power of 120 mg CaO/gm AS. The suspension contained 40% by weight of total solids, including small amounts of unreacted aluminate and silicate. The brightener portion of the total solid was 70%. The suspension obtained was transformed into a beaded powder, as described in Example 1.

EXAMPLE 6

This example describes a variation of the method according to Example 5, where tthe optical brightener was dispersed in the de-ionized water and the aluminate solution, silicate solution and de-ionized water containing the brightener were introduced simultaneously into the reaction vessel under stirring. The following substances were mixed with each other:

8.450 kg of an aluminate solution of the composition:

11.3% $Na_2O_3$, 18.7% $Al_2O_3$, 70.0% $H_2O$ 25.972 kg of de-ionized water with
19.284 kg of the brightener according to Example 1 suspended therein
6.550 kg of a 34.9% sodium silicate solution of the composition:

8.0% $Na_2O$, 26.9% $SiO_2$, 65.1% $H_2O$

The anhydrous, ion-exchanging sodium aluminosilicate formed had the following composition:

$0.95\ Na_2O \cdot 1.0\ Al_2O_3 \cdot 1.89\ SiO_2$ and a calcium binding power of 120 mg CaO/gm AS. The suspension contained 40% by weight of total solids. The brightener portion of the total solid was 80% by weight. The suspension obtained was transformed into a beaded powder, as described in Example 1.

EXAMPLE 7

This example describes a variation of the method according to Example 5 where the optical brightener was dispersed in the sodium silicate solution, and this dispersion, as well as the de-ionized water, were added to the charged borate solution. The following substances were mixed with each other:

5.196 kg of a sodium borate solution of the composition:

9.24% $Na_2O$, 20.76% $B_2O_3$, 70% $H_2O$ 11.322 kg of de-ionized water
6.550 kg of a 34.9% sodium silicate solution of the composition:

8.0% $Na_2O$, 26.9% $SiO_2$, 65.1% $H_2O$, with
8.971 kg of the brightener according to Example 1 suspended therein.

The anhydrous, ion-exchanging sodium borosilicate formed had the following composition:

$0.45\%\ Na_2O \cdot 1.0\ B_2O_3 \cdot 2.48\ SiO_2$ and a calcium binding power of 55 mg CaO/gm AS. The suspension contained 40% by weight of total solids. The brightener portion of the total solid was 70% by weight. The suspension was transformed into a beaded powder, as described in Example 1.

The preparations according to Examples 5 to 7 can also be stored as suspensions, as they are obtained after mixing, and/or processed directly without subjecting them first to a drying process.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A heat-dried, finely-divided composition of optical brighteners and fillers consisting essentially of from 10 to 90% by weight of optical brighteners for textile fibers and from 10 to 90% by weight of fillers wherein from 50 to 100% by weight of said fillers is at least one compound inhibiting alkaline earth metal ion precipitation from aqueous solutions consisting of a finely-dispersed, water-insoluble silicate compound containing at least some combined water and having a calcium binding power of at least 50 mg CaO/gm of anhydrous active substance and the formula on the anhydrous basis $$(M_{2/n}O)_x \cdot Me_2O_3 \cdot (SiO_2)_y$$

where M is a cation of the valence $n$, exchangeable with calcium selected from the group consisting of alkali metal, ammonium and magnesium, $x$ is a number of from 0.7 to 1.5, Me is a member selected from the group consisting of aluminum and boron, and $y$ is a number from 0.8 to 6; and from 0 to 50% by weight of said fillers is an organic hydrotropic compound selected from the group consisting of anionic hydrotropic compounds and non-ionic hydrotropic compounds.

2. The composition of claim 1 wherein $y$ is from 1.3 to 4.

3. The composition of claim 1 wherein the brightener component is from 40 to 90% by weight and the filler component is from 10 to 60% by weight.

4. The composition of claim 1 wherein the brightener component is from 50 to 90% by weight and the filler component is from 10 to 50% by weight.

5. The composition of claim 1 wherein the calcium binding power of said silicate compound is from 100 to 200 mg CaO/gm of anhydrous active substance.

6. The composition of claim 1 wherein said brightener component and said filler component are discrete particles in admixture.

7. The composition of claim 1 wherein at least some of the particles of said brightener component are enveloped by said filler component.

8. A process for the production of the composition of claim 1 which comprises admixing an aqueous suspension of said brightener component and said filler component and converting said suspension into a dry powder by a heat treatment wherein said brightener component is in the moist state for less than 5 minutes.

9. The process of claim 8 wherein said silicate compounds are prepared by mixing aqueous solutions of an alkali metal aluminate and an alkali metal silicate and allowing said silicate compound to precipitate, M is an alkali metal, $n$ is 1, Me is aluminum, $x$ is from 0.7 to 1.5 and $y$ is from 1.3 to 4.

10. The process of claim 8 wherein said brightener component in the form of a moist filter cake containing more than 50% water is transformed by mechanical treatment and optionally by the addition of said organic hydrotropic compound into a fluid or pumpable mass and the remainder of said filler components are added, before the step of converting to a dry powder by heat treatment.

11. A process for the production of the composition of claim 1, wherein M is an alkali metal, which comprises forming an aqueous suspension of said brightener component, forming said water-insoluble silicate compound in said aqueous suspension of said brightener component by mixing aqueous solutions of an alkali metal aluminate and an alkali metal silicate, wherein said brightener component is in the moist state for less than 5 minutes before said formation of said water-insoluble silicate compound, and converting the resultant suspension into a dry powder by a heat treatment.

* * * * *